US012152451B2

(12) United States Patent
Stachowiak, Jr.

(10) Patent No.: US 12,152,451 B2
(45) Date of Patent: Nov. 26, 2024

(54) QUARTER-TURN ANCHOR CATCHER HAVING ANTI-ROTATION SLEEVE AND ALLOWING FOR HIGH ANNULAR FLOW

(71) Applicant: WEATHERFORD TECHNOLOGY HOLDINGS, LLC, Houston, TX (US)

(72) Inventor: John E. Stachowiak, Jr., Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 132 days.

(21) Appl. No.: 17/836,798

(22) Filed: Jun. 9, 2022

(65) Prior Publication Data

US 2023/0399903 A1 Dec. 14, 2023

(51) Int. Cl.
*E21B 23/00* (2006.01)
*E21B 23/01* (2006.01)

(52) U.S. Cl.
CPC ..... *E21B 23/01* (2013.01); *E21B 23/006* (2013.01)

(58) Field of Classification Search
CPC ..... E21B 23/01; E21B 23/006
See application file for complete search history.

(56) References Cited

U.S. PATENT DOCUMENTS

| | | | |
|---|---|---|---|
| 3,664,417 | A | 5/1972 | Conrad |
| 5,327,975 | A | 7/1994 | Land |
| 9,890,603 | B2 | 2/2018 | Moore et al. |
| 2013/0319683 | A1 | 12/2013 | Aldridge |
| 2015/0041153 | A1 | 2/2015 | Moore et al. |
| 2015/0259998 | A1 | 9/2015 | Moore |
| 2017/0350204 | A1 | 12/2017 | Moore |
| 2018/0100365 | A1 | 4/2018 | Perales et al. |
| 2018/0355689 | A1 | 12/2018 | Bringham |
| 2020/0325750 | A1 | 10/2020 | Zachry et al. |

FOREIGN PATENT DOCUMENTS

| | | | |
|---|---|---|---|
| CA | 2890533 | C | 11/2017 |

OTHER PUBLICATIONS

Tech TAC, "Slimline Tubing Anchor Catchers," Brochure, undated, downloaded from www.tubinghanchor.com on Jun. 9, 2020, 2 pages.

Tech TAC, "Setting and Releasing Tubing Anchor Catcher," Brochure, undated, downloaded from www.tubinghanchor.com on Jun. 9, 2020, 1 pg.

(Continued)

*Primary Examiner* — D. Andrews
*Assistant Examiner* — Ronald R Runyan
(74) *Attorney, Agent, or Firm* — Cabello Hall Zinda, PLLC

(57) ABSTRACT

An anchor catcher tool can support tubing in casing. The tool is a slimline tool that can be set and unset with a partial (quarter) turn of a mandrel using a setting mechanism, such as a J-slot and pin arrangement. Uphole and downhole cages of the tool carry opposing slips. When set, the slips engage opposing cone faces to wedge against the casing and prevent movement of the tool. Excluded gas can flow up the annulus to the surface through aligned longitudinal flow paths on the exterior of the tool's components. To do this, a sleeve floating on the mandrel has the cone faces thereon and is longitudinally engaged with cages, which float on the mandrel and carry the slips. The sleeve keeps longitudinal channels on the cages and longitudinal divisions of the cone faces aligned with one another to produce the flow paths for annular flow.

20 Claims, 5 Drawing Sheets

(56) References Cited

OTHER PUBLICATIONS

Tech TAC, "Slimline Tubing Anchor Catcher," Brochure, undated, downloaded from www.tubinghanchor.com on Jun. 9, 2020, 1 pg.
Evolution Oil Tools, Inc., "CRTA Rotating Tubing Anchor Catcher," Brochure, dated Sep. 2011, 2-pgs.
Q2 Artificial Lift Services, "Q2-SLIM TAC," Brochure, undated, downloaded from www.Q2als.com on Jun. 9, 2020, 1-pg.
Don Nam, "Slimhole Tubing Anchor Catcher," Brochure, file dated Oct. 26, 2020, downloaded from www.don-nan.com on Jun. 9, 2020, 2-pgs.
Don Nam, Type B Tubing Anchor Catcher, Brochure, file dated Oct. 26, 2020, downloaded from www.don-nan.com on Jun. 9, 2020, 1-pg.
Weatherford, "BA Tubing Anchor Catcher," Brochure, copyright 2007, 2-pgs.
International Search Report and Written Opinion in PCT/US2023/018120, mailed Jun. 21, 2023, 10-pgs.

QUARTER-TURN ANCHOR CATCHER HAVING ANTI-ROTATION SLEEVE AND ALLOWING FOR HIGH ANNULAR FLOW

BACKGROUND OF THE DISCLOSURE

A tubing anchor is installed on a tubing string and allows the lower section of the tubing to be anchored to casing. The tubing anchor allows the tubing to be placed in tension to prevent movement during a rod lift pumping cycle. Typical tubing anchors have a diameter that is very close to the casing's inner dimension, which leaves very little annulus between the anchor and the casing. This can prevent excluded gas from the well from flowing up the wellbore to the surface.

One type of tubing anchor is a "slim" or "slimline" tubing anchor. This "slim" type of tubing anchor has a housing that is much smaller in diameter than the inner dimension of the casing. The smaller diameter housing increases the annular area to allow gas to flow past the anchor. Such a "slim" tubing anchor has two opposing cones with a single, bi-directional slip disposed between the cones. This is typically referred to as a unitary slip arrangement. The "slim" tubing anchor operates by rotating the tubing string multiple turns from the surface. The opposing cones are independently threaded to a mandrel, which contains threads in opposing directions. Rotating the tubing string causes the cones to move inward or outward from one another depending on the direction of the rotation. When the cones are moved inward, the ramps on either end of the single, bi-directional slip cause the slip to move radially outward and to bite against the casing wall. This type of "slim" tubing anchor has its limitations, such as being difficult to set in deviated sections of wells and having a unitary slip arrangement.

The subject matter of the present disclosure is directed to overcoming, or at least reducing the effects of, one or more of the problems set forth above.

SUMMARY OF THE DISCLOSURE

An anchor catcher tool is used for supporting tubing in casing. The anchor catcher tool comprises a mandrel, a sleeve, a first cage, and a second cage. The mandrel has an end configured to couple to the tubing, and the sleeve is movably disposed on the mandrel and has first and second ends. The sleeve has first and second cone faces, which face respectively toward the first and second ends. The first and second cone faces define one or more longitudinal divisions.

The first and second cages are movably disposed on the mandrel. The first cage has one or more first slips, and the second cage has one or more second slips. The first cage defines one or more first longitudinal channels between the one or more first slips, and the second cage defines one or more second longitudinal channels between the one or more second slips. The first cage is movably engaged in a longitudinal direction with the first end of the sleeve, and the one or more first slips being configured to engage against the first cone face and being configured to engage against the casing. The second cage is movably engaged in the longitudinal direction with the second end of the sleeve, and the one or more second slips being configured to engage against the second cone face and being configured to engage against the casing.

On the sleeve, the first longitudinal slot can be disposed toward the sleeve's first end, and the second longitudinal slot can be disposed toward the sleeve's second end. The first cage is movably engaged in the first longitudinal slot of the sleeve, and the second cage is movably engaged in the second longitudinal slot of the sleeve. The first and second longitudinal slots are configured to longitudinally align the first longitudinal channels, the second longitudinal channels, and the longitudinal divisions with one another.

A method of supporting tubing in casing comprises: running a tubing anchor catcher (TAC) tool on the tubing in the casing; and setting the TAC tool in the casing at depth. Setting the TAC tool includes the steps of: moving a setting mechanism of the TAC tool from an unset condition to a set condition by manipulating a mandrel of the TAC tool with a partial turn; wedging uphole and downhole slips of the TAC tool against the casing by engaging the uphole and downhole slips against opposing cone faces of the TAC tool; and allowing for annular flow between the TAC tool and the casing by having uphole longitudinal channels between the uphole slips, downhole longitudinal channels between the downhole slips, and longitudinal divisions in the cone faces aligned with one another.

The foregoing summary is not intended to summarize each potential embodiment or every aspect of the present disclosure.

DETAILED DESCRIPTION OF THE DISCLOSURE

Reciprocating pump systems, such as sucker rod pump systems, extract fluids from a well and employ a downhole pump connected to a driving source at the surface. A rod string connects the driving force at the surface to the downhole pump in the well. When operated, the driving source cyclically raises and lowers the downhole pump, and with each stroke, the downhole pump lifts well fluids toward the surface.

Figure 1:
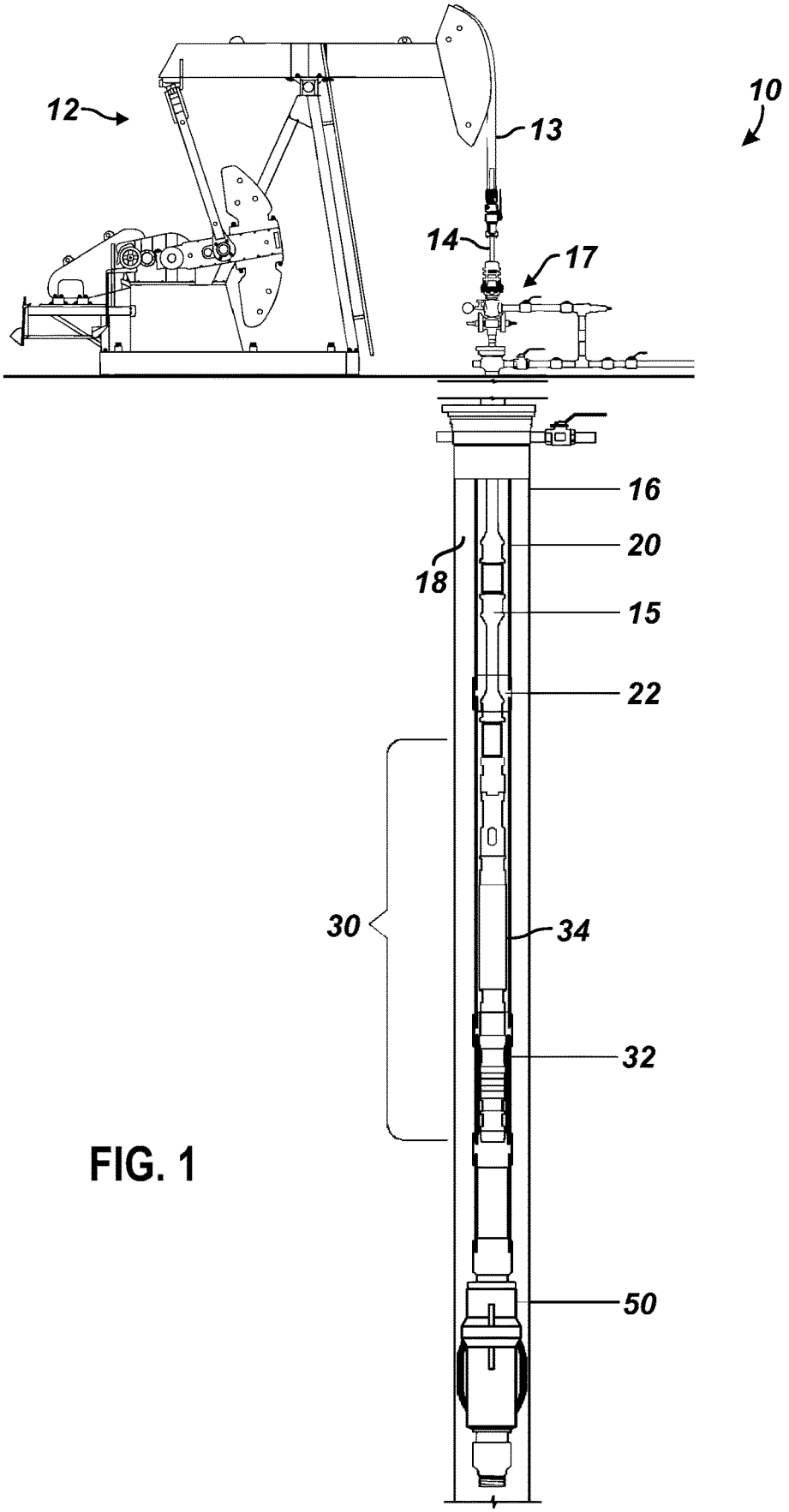
FIG. 1 illustrates a sucker rod pump system 10 having a tubing anchor catcher according to the present disclosure.

For example, FIG. 1 shows a sucker rod pump system 10 used to produce fluid from a well. A downhole pump 30 has a barrel 32 connected to production tubing 20 disposed in casing 16 of a wellbore. The barrel 32 has a standing valve located at the bottom. This standing valve allows fluid to enter from the wellbore, but does not allow the fluid to leave. Inside the pump barrel 32, a plunger 34 has a traveling valve located at the bottom of the plunger 34. This traveling valve allows fluid to move from below the plunger 34 to the production tubing 20 above, but does not allow fluid to return from the tubing 20 to the pump barrel 32 below the plunger 34. A driving source (e.g., a pump jack or pumping unit 12) at the surface connects by a rod string 15 to the plunger 34 and moves the plunger 34 up and down cyclically in upstrokes and downstrokes in the barrel 32.

At the surface, for example, the pump jack 12 is driven by a prime mover, such as an electric motor or internal combustion engine. A flexible wire rope bridle 13 is connected to a horsehead of the pump jack 12 and connects by a carrier bar to a polished rod 14. The polished rod 14 passes through a packing gland or stuffing box 17 on the well, and the rod string 15 of connected sucker rods hangs from the polished rod 14 through the production string 20 to the plunger 34 in the downhole pump 30.

The production tubing 20 is supported in tension in the casing 16 of the well using a tubing anchor catcher (TAC) tool 50 at the end of the production tubing 20. The TAC tool 50 installed on the production tubing 20 allows the lower tubing section to be anchored to the casing 16 and limits movement of the tubing 20 both axially and radially during a rod lift pumping cycle.

Although not depicted in FIG. 1, heavier weight casing 16 may be used in the well to handle any bends or curves in the well, which may be drilled with deviations and horizontal sections. Naturally, the thicker wall of the heavier weight casing 16 reduces the inner diameter inside the casing 16. The reduced diameter and possible bends of the casing 16 ultimately make it difficult to set a tubing anchor. For example, setting a tubing anchor having a unitary slip configuration can be difficult in casing 16 having bends. Therefore, the TAC tool 50 of the present disclosure preferably uses separate and opposing slips, rather than a unitary slip, for anchoring and catching. The separate slips allow for improved, independent engagement into the casing wall. Moreover, setting a tubing anchor having threads or helical bearings that require multiple full rotations of a mandrel to either set or unset the anchor can be difficult in casing 16 having bends. Therefore, the TAC tool 50 of the present disclosure preferably uses a partial (quarter)-turn mechanism to set and unset in the casing 16.

The reduced diameter and possible bends of the casing 16 can also reduce the annular space available between the TAC tool 50 and the casing 16, which can limit fluid communication. Therefore, the TAC tool 50 of the present disclosure is preferably a "slimline" tool having a reduced tool diameter to fit within casing 16 having a reduced inner diameter. Yet, the "slimline" TAC tool 50 still achieves the desired anchoring function for the production tubing 20 by using slip engagement and drag block engagement with the casing 16.

As will also be appreciated, the production tubing 20 is typically made up of sections of individual pipe joints that are threaded or coupled together with couplings 22 or the like. Should a portion of the production tubing 20 or downhole pump 30 become disengaged for whatever reason, the TAC tool 50 preferably prevents the tubing 20 from falling further downhole. Therefore, in addition to the anchoring function, the TAC tool 50 of the present disclosure provides a catching function that uses opposing slips for engaging in the casing 16 in both uphole and downhole directions. The slips in a unitary slip arrangement can also act as "catchers" because they can incorporate bi-directional teeth. However, the slip arrangement of the disclosed TAC tool 50 having separate and opposing slips for anchoring and catching is superior especially when the casing 16 has bends or irregular surfaces.

Finally, the TAC tool 50 includes longitudinal channels aligned about the exterior components of the TAC tool 50 to provide pathways or flow paths for fluid communication in the annulus 18 between the tool 50 and the casing 16. The longitudinal channels open pathways for the passage of flow in the annulus between the TAC tool 50 and the casing 16. In this way, the channels can allow excluded gas from the well to flow past the TAC tool 50, up the annulus 18, and to the surface.

Figure 2A:
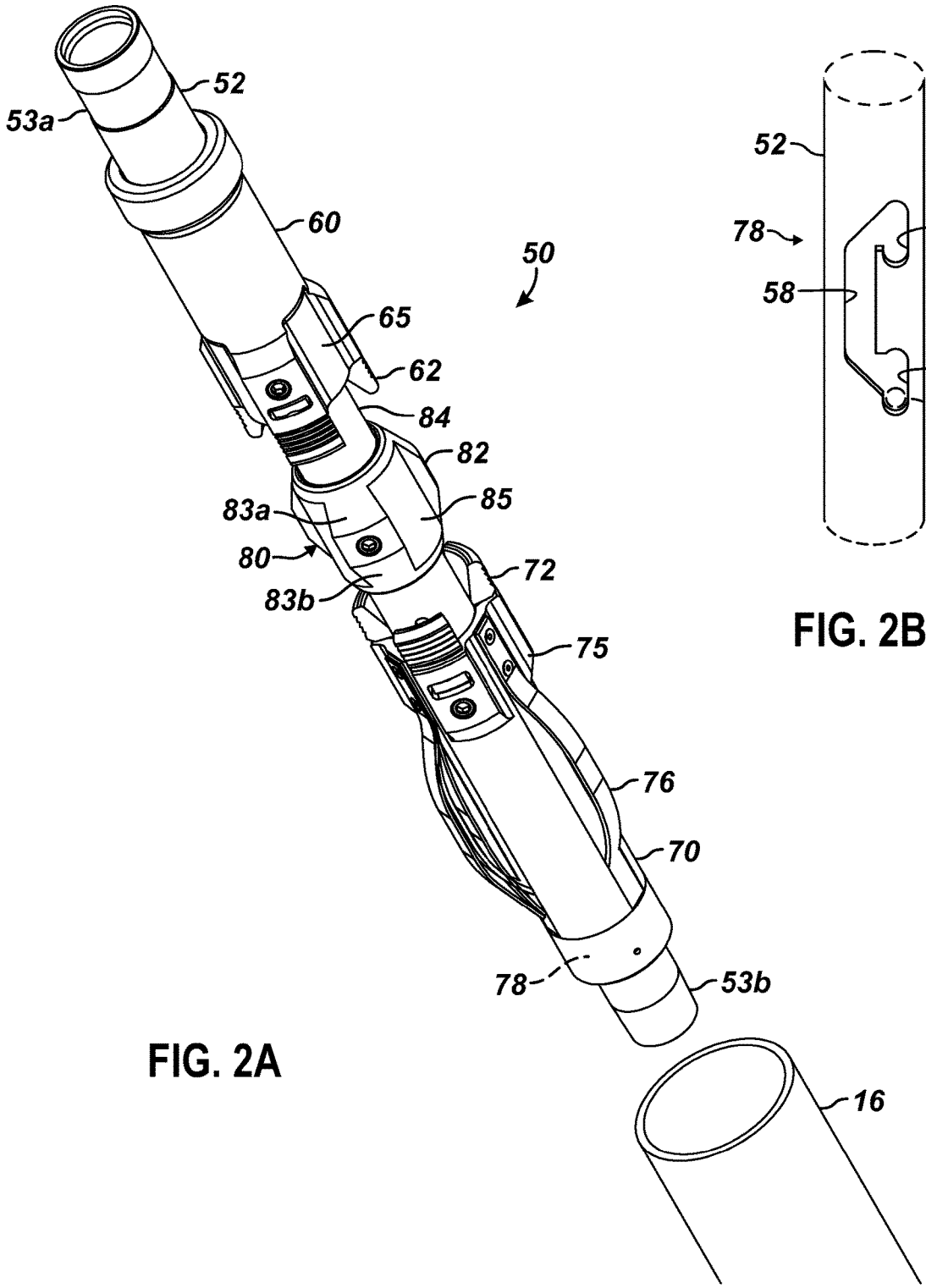
FIG. 2A illustrates a perspective view of a tubing anchor catcher according to the present disclosure.

Having an understanding of the TAC tool 50 and its use in supporting tubing 20 in casing 16, reference is now made to FIG. 2A, which shows a perspective view of a TAC tool 50 for supporting tubing in the casing. The TAC tool 50 includes a mandrel 52 having a first cage 60, a sleeve 80, and a second cage 70, each of which is disposed on the mandrel 52. The mandrel 52 has uphole and downhole ends 53*a-b*, and the uphole end 53*a* is configured to couple to the tubing (20).

The sleeve 80 is movably disposed (e.g., floating) on the mandrel 52 between the cages 60, 70. The sleeve 80 has first and second cone faces 83*a-b*, which can be disposed on a cone body 82 affixed to a sleeve body 84 of the sleeve 80. The cone faces 83*a-b* face in opposing directions, and the cone body 82 defines longitudinal divisions 85 between the faces 83*a-b*.

Figure 5A:
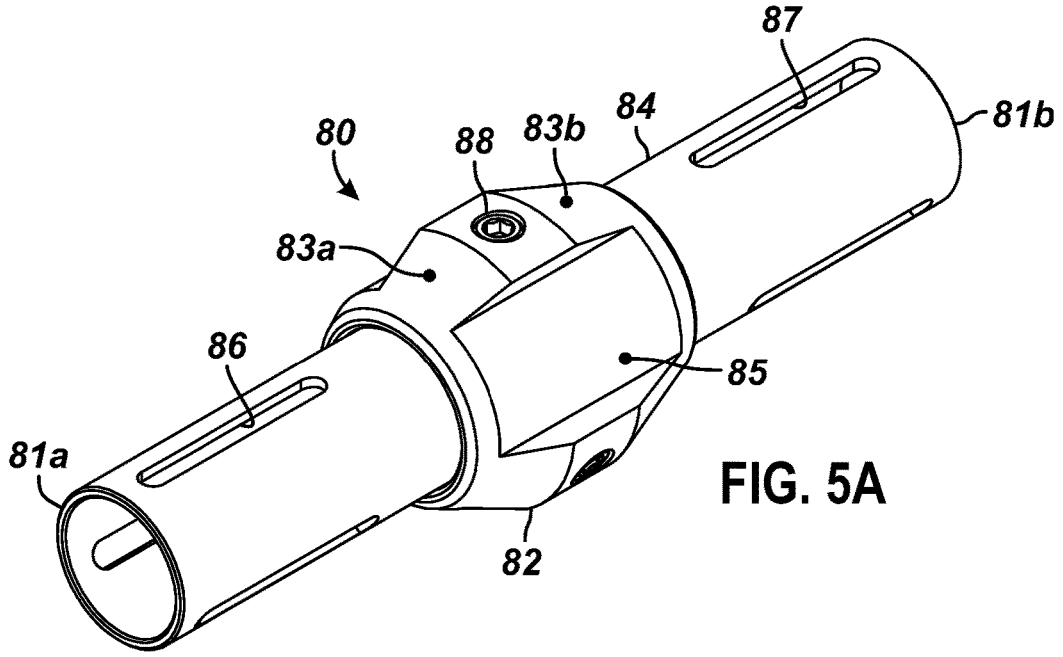
FIG. 5A illustrates a perspective view of a sleeve for the tubing anchor catcher.
Figure 5B:
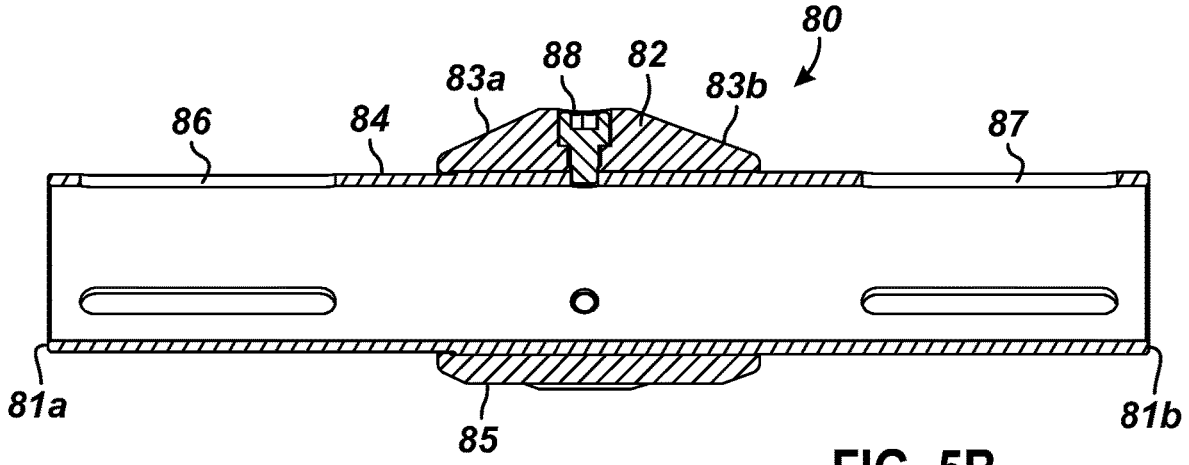
FIG. 5B illustrates a cross-sectional view of the sleeve in FIG. 5A.

The first (uphole) cage 60 is movably disposed (e.g., floating) on the mandrel 52. The uphole cage 60 has one or more first slips 62 and defines one or more first longitudinal channels 65 between them. As shown here, three slips 62 may be disposed radially about the cage 60, but other numbers could be used. The uphole cage 60 is movably and longitudinally engaged with an upper end (81*a*; FIGS. 5A-5B) of the sleeve 80. When the sleeve 80 (sleeve body 84/cone body 82) and the uphole cage 60 are moved longitudinally toward one another, the first slips 62 engage against the first cone faces 83*a* and are wedged outward to engage against a surrounding wall of casing (16).

The second (downhole) cage 70 is also movably disposed (e.g., floating) on the mandrel 52. The downhole cage 70 has one or more second slips 72 and defines one or more second longitudinal channels 75 between the second slips 72. As shown here, three slips 72 are symmetric to the other slips 62 radially disposed about the downhole cage 70, but other numbers could be used. The downhole cage 70 also includes drag elements 76, such as springs or blocks, to engage inside the casing 16.

Figure 2B:
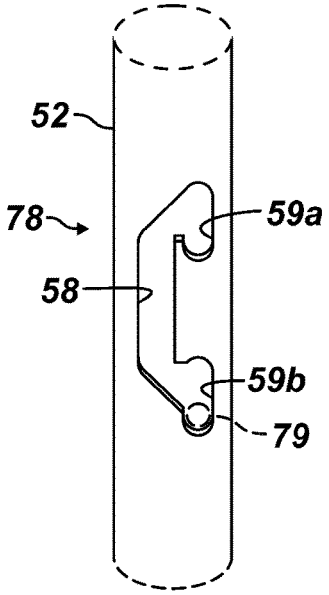
FIG. 2B illustrates a schematic view of the mandrel with the J-Slot arrangement.

Setting and unsetting the TAC tool 50 uses a setting mechanism 78. For example, FIG. 2B schematically illustrates a J-sot arrangement, which can be used for the setting mechanism 78 of the TAC tool 50. Briefly, the J-slot arrangement 78 includes a J-slot 58 and a pin 79. The J-slot 58 is defined in the outer surface of the tool's mandrel 52, and the pin 79 is disposed in the J-slot 58. The pin 79 is connected to the downhole cage (70), which is movably disposed on the mandrel 52. (A reverse arrangement of J-slot and pin can be used.) During setting and unsetting, the pin 79 is movably disposed in the J-slot 58 between first and second conditions, which use catch slots 59*a-b* for engaging the pin 79. Typically, more than one combination of J-slot 58 and pin 79 are used around the circumference of the mandrel 52.

During setting and unsetting of the TAC tool 50 in FIG. 2A, the downhole cage 70 is longitudinally and movably engaged with a lower end (81*b*; FIGS. 5A-5B) of the sleeve 80. When the sleeve 80 (sleeve body 84/cone body 82) and the downhole cage 70 are moved longitudinally toward one another, the second slips 72 are configured to engage against the second cone faces 83*b* and are wedged outward to engage against the casing (16).

The longitudinal channels 65, 75 on the cages 60, 70 and the longitudinal divisions 85 on the cone body 82 are all arranged to align with one another. This alignment is maintained even though the mandrel 52 is moved and rotated a partial turn to set the TAC tool 50, as discussed below.

Figure 3A:
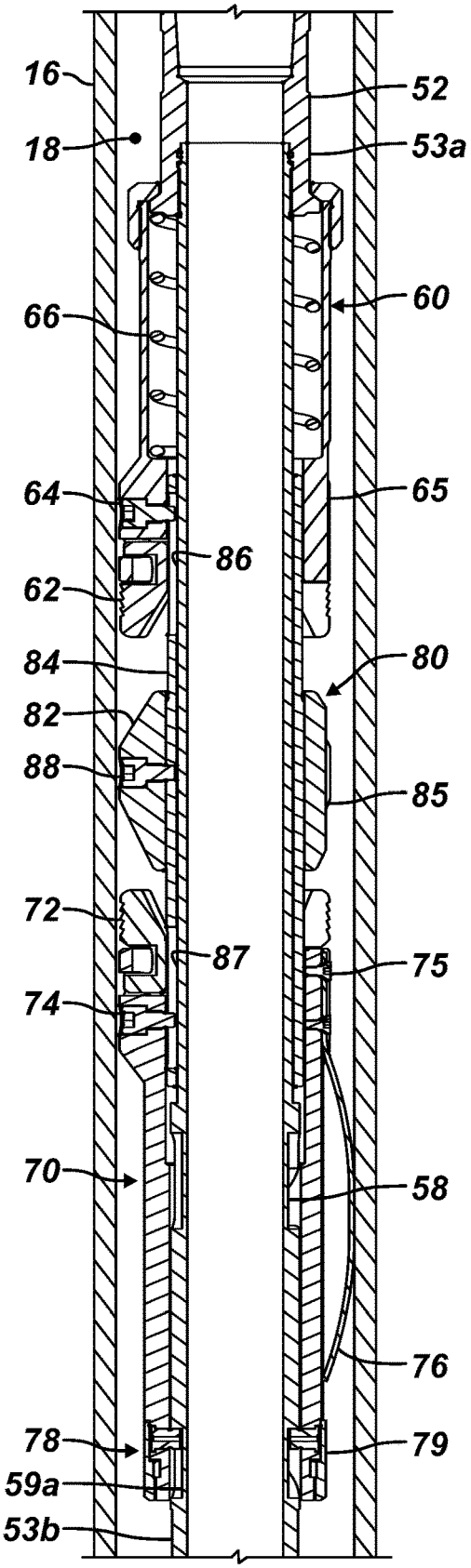
FIG. 3A illustrates a cross-sectional view of the tubing anchor catcher in a run-in condition.
Figure 3B:
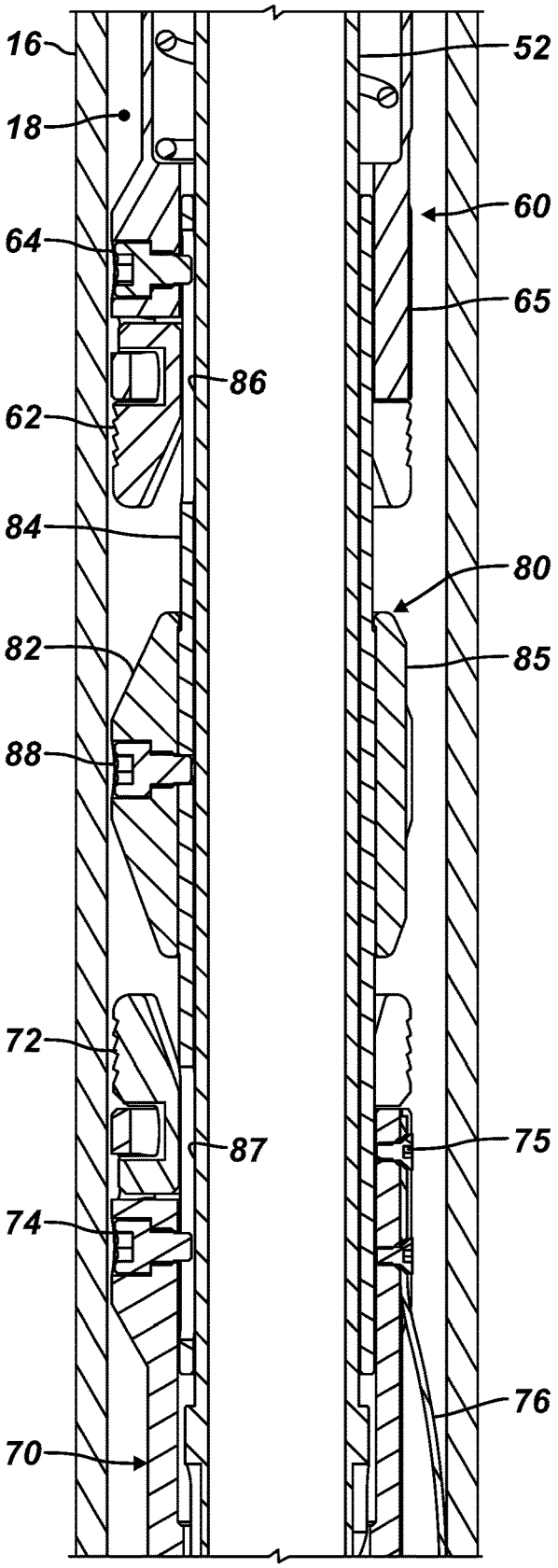
FIG. 3B illustrates a portion of FIG. 3A in more detail.
Figure 4A:
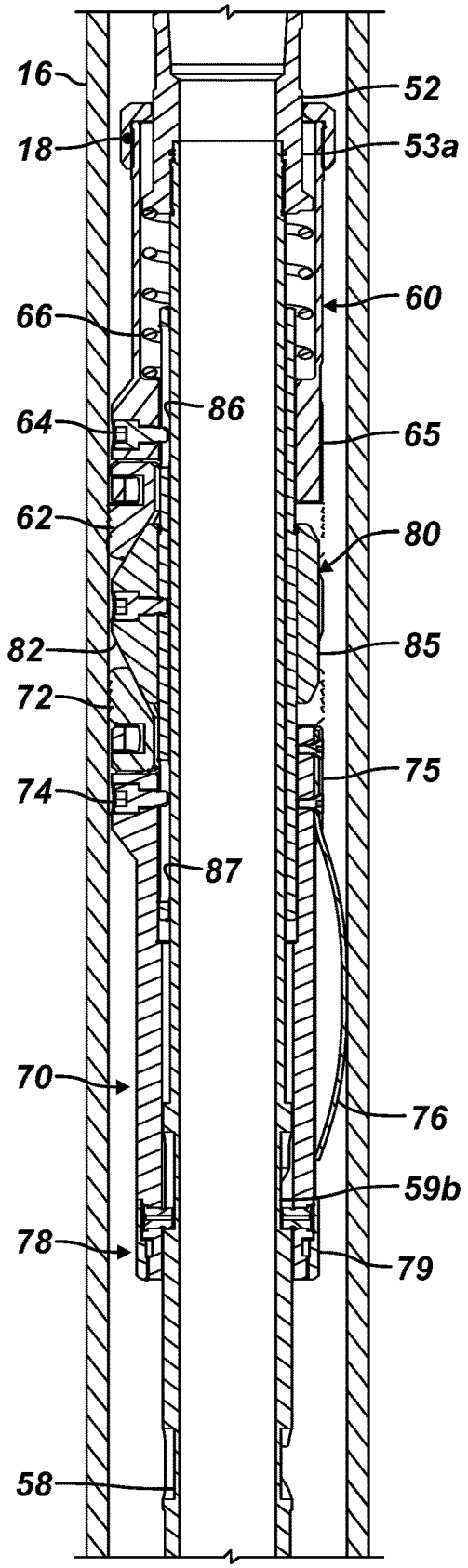
FIG. 4A illustrates a cross-sectional view of the tubing anchor catcher in a set condition.
Figure 4B:
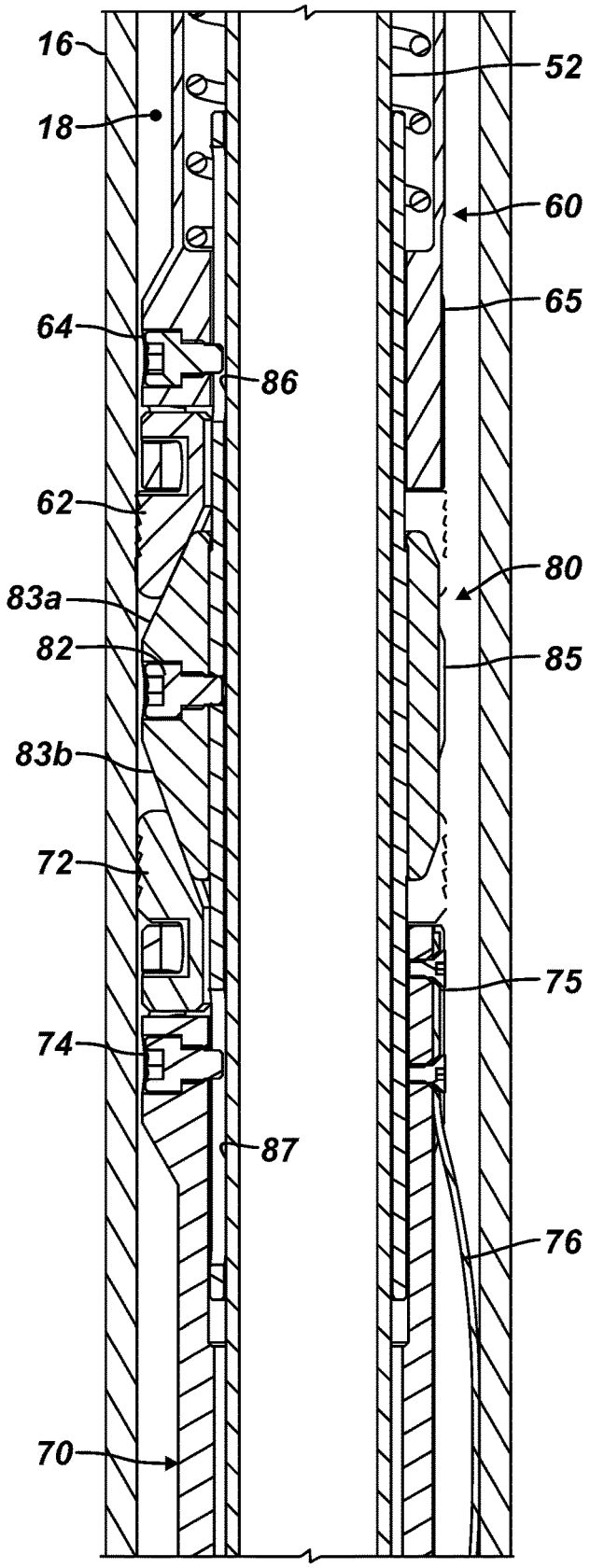
FIG. 4B illustrates a portion of FIG. 4A in more detail.

Looking at the TAC tool 50 in more detail, FIG. 3A illustrates a cross-sectional view of the TAC tool 50 in a run-in condition, and FIG. 3B illustrates a portion of FIG. 3A in more detail. Meanwhile, FIG. 4A illustrates a cross-sectional view of the TAC tool 50 in a set condition, and FIG. 4B illustrates a portion of FIG. 4A in more detail.

As shown in FIG. 3A, the uphole cage 60 includes a biasing element or spring 66 disposed between the uphole cage 60 and the mandrel 52. The spring 66 tends to bias the uphole cage 60 away from the end 53*a* where the mandrel 52 is coupled to the tubing (20). Meanwhile, the downhole cage 70 includes drag springs, drag block, or other drag elements 76 disposed thereabout. These drag elements 76 are configured to engage against the casing (16), which allows the mandrel 52 to be manipulated during setting and unsetting relative to the downhole cage 70.

During the run-in condition of the TAC tool 50 in FIG. 3A, the sleeve 80 keeps the longitudinal channels 65, 75 of the cages 60, 70 longitudinally aligned with the longitudinal divisions 85 of the cone body 82. Additionally, the sleeve 80 in the run-in condition also keeps the cone body 82 from traveling against the slips 62, 72, which could cause premature setting. For example, the lower end 81*a* of the sleeve 80 can engage against a shoulder on the mandrel 52 to limit movement of the cone 82 toward the lower slips 72. Also, the pins 64, 74 can engage the ends of the longitudinal slots 86, 87 to limit the movement of the cone body 82 towards either of the slips 62, 72.

For setting and unsetting, the mandrel 52 and the downhole cage 70 comprise a setting mechanism 78 operated by a partial turn. In the present configuration, the setting mechanism 78 is a J-slot and a pin mechanism between the mandrel 52 and the downhole cage 70. As shown here and noted previously with reference to FIG. 2B, the mandrel 52 defines the J-slot 58, and the downhole cage 70 comprises the pin 79. The pin 79 is movably disposed in the J-slot 58 between first and second conditions, which use catch slots 59*a-b* for engaging the pin 79. (A reverse J-slot and pin arrangement can be used.)

As shown in FIG. 3A, the J-slot and pin mechanism 78 in a first (run-in) condition has the pin 79 in the lower catch slot 59*a*. In this run-in condition, the mechanism 78 is configured to position the downhole cage 70 on the mandrel 52 away from the uphole cage 60. Meanwhile as shown in FIG. 4A, the J-slot and pin mechanism 78 in a second (set) condition has the pin 79 in the upper catch slot 59*b*. In this set condition, the mechanism 78 is configured to position the downhole cage 70 on the mandrel 52 toward the uphole cage 60.

Moving between the run-in and set conditions involves manipulating the mandrel 52 relative to the downhole cage 70, which is engaged with the casing 16 by the drag elements 76. Longitudinal manipulation of the mandrel 52 downhole moves the pin 79 out of the lower catch 59*a* (FIG. 3A); a partial (quarter) turn plus longitudinal manipulation of the mandrel 52 uphole moves the pin 79 toward the set condition (FIG. 4A); and longitudinal manipulation of the mandrel 52 downhole moves the pin 79 into the upper catch 59*b* (FIG. 4A).

Figure 5C:
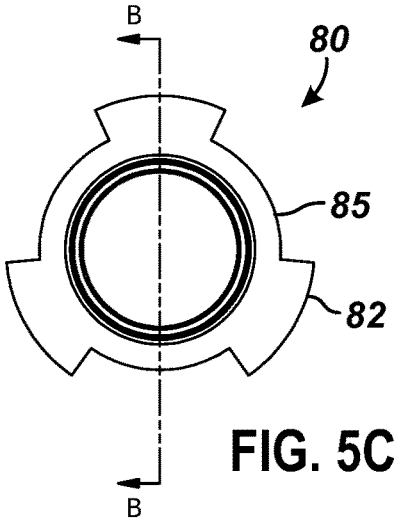
FIG. 5C illustrates an end view of the sleeve in FIG. 5A.

Looking briefly at the sleeve 80, FIG. 5A illustrates a perspective view of the sleeve 80; FIG. 5B illustrates a cross-sectional view of the sleeve 80 in FIG. 5A; and FIG. 5C illustrates an end view of the sleeve 80 in FIG. 5A. The sleeve 80 comprises a cone body 82 disposed about a sleeve body 84 of the sleeve 80, and fasteners 88 or the like can attach the cone body 82 to the sleeve 80. The cone body 82 has the first and second cone faces 83*a-b* and defines the longitudinal divisions 85.

The sleeve 80 defines one or more first longitudinal slots 86 disposed toward an upper end 81*a* and defines one or more second longitudinal slots 87 disposed toward a lower end 81*b*. As shown here in FIGS. 5A-5B, sets of three slots 86, 87 can be used.

As shown in FIGS. 3A through 4B, the sleeve 80 engages longitudinally with the cages 60, 70 using the longitudinal slots 86, 87. For example, the uphole cage 60 comprises first pins 64 movably disposed in the first longitudinal slots 86 of the sleeve 80, while the downhole cage 70 comprises second pins 74 movably disposed in the second longitudinal slots 87 of the sleeve 80. A reverse arrangement of slots 86, 87 and pins 64, 74 can be used.

As arranged, the longitudinal slots 86, 87 of the sleeve 80 engaged with the pins 64, 74 of the cages 60, 70 are configured to longitudinally align the longitudinal channels 65, 75 of the cages 60, 70 and the longitudinal divisions 85 of the cone body 82 with one another. In other words, the cages 60, 70 and the sleeve 80 can move longitudinally relative to one another during the setting and unsetting of the slips 62, 72 with the cone faces 83*a-b* of the cone body 82, but they do not rotate relative to one another. Instead, the cages 60, 70 and the sleeve 80 are aligned longitudinally together on the mandrel 52 and can float on the mandrel 52, which can be rotated and moved longitudinally on its own.

The operation of the TAC tool 50 is as follows. Starting with FIGS. 3A-3B, the TAC tool 50 has the unset condition when run into the casing 16. The pin 79 of the setting mechanism 78 is arranged in the lower catch slot 59*a* of the J-slot 58. Therefore, the slips 62, 72 of the cages 60, 70 are spaced from the cone faces 83*a-b* of the sleeve's cone body 82. When setting depth is reached, the mandrel 52 is manipulated uphole to bring the pin 79 out of the lower catch slot 59*a* while the downhole cage 70 drags in the casing 16.

As shown in FIG. 4A-4B, rotation and downhole manipulation of the mandrel 52 brings the pin 79 toward the upper catch slot 59*b* while the downhole cage 70 drags in the casing 16. The slips 62 on the uphole cage 60 are moved longitudinally toward the upper cone face 83*a* with the cage 60 biased by the spring 66 engaged with the mandrel 52. Likewise, the slips 72 on the downhole cage 70 are moved longitudinally toward the lower cone face 83*b* with the cage 70 dragged in the casing 16.

Uphole movement of the mandrel 52 pulls tension on the tubing (20) and fits the pin 79 in the upper catch slot 59*b* to lock the TAC tool 50 as being set. The upper slips 62, being wedge against the cone faces 83*a* and biased by spring 66, engage (bit into) the wall of the casing 16. The engagement can counter any upward force on the TAC tool 50. Meanwhile, the lower slips 72, being wedge against the cone faces 83*b*, engage (bite into) the wall of the casing 16. The engagement can counter any downward force on the TAC tool 50.

All the while during these manipulations, the longitudinal slots 86, 87 of the sleeve 80 engaged with the pins 64, 74 of the cages 60, 70 keep the longitudinal channels 65, 75 of the cages 60, 70 and the longitudinal divisions 85 of the cone body 82 longitudinally aligned with one another. As the mandrel 52 is manipulated, for example, the cages 60, 70 and the sleeve 80 can move longitudinally relative to one another with the pins 64, 74 sliding in the slots 86, 87, but the cages 60, 70 and sleeve 80 do not rotate relative to one another. Instead and as noted, they are aligned longitudinally together on the mandrel 52, which can be rotated and moved longitudinally on its own. The longitudinal channels 65, 75, 85 aligned about the exterior components of the TAC tool 50 provide pathways or flow paths for fluid communication in the annulus 18 between the tool 50 and the casing 16. In this way, the longitudinal channels 65, 75, 85 can allow excluded gas from the well to flow up the annulus 18 to the surface.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An anchor catcher tool for supporting tubing in casing, the anchor catcher tool comprising:

a mandrel having an end configured to couple to the tubing;

a sleeve movably disposed on the mandrel and having first and second ends, the sleeve having first and second cone faces, the first and second cone faces facing respectively toward the first and second ends, the first and second cone faces defining one or more longitudinal divisions;

a first cage movably disposed on the mandrel, the first cage having one or more first slips and defining one or more first longitudinal channels between the one or more first slips, the first cage disposed at least partially on the first end of the sleeve and being movable in a longitudinal direction relative to the first end of the sleeve, the one or more first slips being configured to engage against the first cone face and being configured to engage against the casing; and a second cage movably disposed on the mandrel, the second cage having one or more second slips and defining one or more second longitudinal channels between the one or more second slips, the second cage disposed at least partially on the second end of the sleeve and being movable in the longitudinal direction relative to the second end of the sleeve, the one or more second slips being configured to engage against the second cone face and being configured to engage against the casing.

2. The anchor catcher tool of claim 1, wherein the first cage comprises a biasing element disposed between the first cage and the mandrel, the biasing element configured to bias the first cage away from the end of the mandrel configured to couple to the tubing.

3. The anchor catcher tool of claim 1, wherein the second cage comprises a drag element, a drag block, or a drag spring disposed thereabout and configured to engage against the casing.

4. The anchor catcher tool of claim 1, wherein the mandrel and the second cage comprise a J-slot and a pin arranged therebetween, the pin being movably disposed in the J-slot between first and second conditions.

5. The anchor catcher tool of claim 4, wherein the mandrel defines the J-slot; and wherein the second cage comprises the pin.

6. The anchor catcher tool of claim 4, wherein the J-slot and pin arrangement in the first condition is configured to position the second cage on the mandrel away from the first cage, and wherein the J-slot and pin arrangement in the second condition is configured to position the second cage on the mandrel toward the first cage.

7. The anchor catcher tool of claim 1, wherein the sleeve defines a first longitudinal slot disposed toward the first end and defines a second longitudinal slot disposed toward the second end; wherein the first cage comprises a first pin movably disposed in the first longitudinal slot of the sleeve, whereby the first cage disposed at least partially on the first end of the sleeve is movable in the longitudinal direction relative to the first end of the sleeve; and wherein the second cage comprises a second pin movably disposed in the second longitudinal slot of the sleeve, whereby the second cage disposed at least partially on the second end of the sleeve is movable in the longitudinal direction relative to the second end of the sleeve.

8. The anchor catcher tool of claim 7, wherein the first and second longitudinal slots are configured to longitudinally align the one or more first longitudinal channels, the one or more second longitudinal channels, and the one or more longitudinal divisions with one another.

9. The anchor catcher tool of claim 1, wherein the sleeve comprises a cone disposed about the sleeve, the cone having the first and second cone faces with the one or more longitudinal divisions.

10. The anchor catcher tool of claim 1, wherein the one or more first slips comprise a plurality of the first slips radially arranged about the first cage, and wherein the one or more second slips comprise a same number of the second slips radially arranged about the second cage.

11. The anchor catcher tool of claim 1, wherein the sleeve is configured to longitudinally align at least one of the one or more longitudinal divisions with at least one of the one or more first longitudinal channels and at least one of the one or more second longitudinal channels.

12. An anchor catcher tool for supporting tubing in casing, the anchor catcher tool comprising:

a mandrel having uphole and downhole ends, the uphole end configured to couple to the tubing;

a sleeve movably disposed on the mandrel and having first and second ends, the sleeve having first and second cone faces and having first and second longitudinal slots, the first and second cone faces facing respectively toward the first and second ends, the first and second cone faces defining longitudinal divisions, the first longitudinal slot disposed toward the first end, the second longitudinal slot disposed toward the second end;

a first cage movably disposed on the mandrel toward the first end of the sleeve, the first cage having first slips and defining first longitudinal channels between the first slips, the first cage movably engaged in the first longitudinal slot of the sleeve, the first slips being configured to engage in a first direction against the first cone face and being configured to engage against the casing; and a second cage movably disposed on the mandrel toward the second end of the sleeve, the second cage having second slips and defining second longitudinal channels between the second slips, the second cage movably engaged in the second longitudinal slot of the sleeve, the second slips being configured to engage in a second direction against the second cone face and being configured to engage against the casing, wherein the first and second longitudinal slots are configured to longitudinally align the first longitudinal channels, the second longitudinal channels, and the longitudinal divisions with one another.

13. The anchor catcher tool of claim 12, wherein the second cage comprises a drag element, a drag block, or a drag spring disposed thereabout and configured to engage against the casing.

14. The anchor catcher tool of claim 12, wherein the mandrel and the second cage comprise a J-slot and a pin arranged therebetween, the pin being movably disposed in the J-slot between first and second conditions, wherein the J-slot and the pin arrangement in the first condition is configured to position the second cage on the mandrel away from the first cage, and wherein the J-slot and the pin arrangement in the second condition is configured to position the second cage on the mandrel toward the first cage.

15. The anchor catcher tool of claim 12, wherein the sleeve defines the first longitudinal slot disposed toward the first end and defines the second longitudinal slot disposed toward the second end; wherein the first cage comprises a first pin movably disposed in the first longitudinal slot of the sleeve, whereby the first cage is movably engaged in the first longitudinal slot of the sleeve; and wherein the second cage comprises a second pin movably disposed in the second longitudinal slot of the sleeve, whereby the second cage is movably engaged in the second longitudinal slot of the sleeve.

16. The anchor catcher tool of claim 12, wherein the first cage comprises a biasing element disposed between the first cage and the mandrel, the biasing element configured to bias the first cage away from the uphole end of the mandrel configured to couple to the tubing.

17. A method of supporting tubing in casing, the method comprising:

running a tubing anchor catcher (TAC) tool on the tubing in the casing; and setting the TAC tool in the casing at depth by:

moving a setting mechanism of the TAC tool from an unset condition to a set condition by manipulating a mandrel of the TAC tool with a partial turn;

wedging uphole and downhole slips of the TAC tool against the casing by engaging the uphole and downhole slips against opposing cone faces of the TAC tool, the opposing cone faces having longitudinal divisions; and allowing for annular flow between the TAC tool and the casing by:

floating a sleeve on the mandrel, the sleeve having the opposing cone faces;

floating an uphole cage carrying the uphole slips on the mandrel, the uphole cage having uphole channels between the uphole slips;

floating a downhole cage carrying the downhole slips on the mandrel, the downhole cage having downhole channels between the downhole slips;

engaging the sleeve in longitudinal freedom with the uphole cage;

engaging the sleeve in longitudinal freedom with the downhole cage; and having the uphole channels between the uphole slips, the downhole channels between the downhole slips, and the longitudinal divisions in the opposing cone faces aligned with one another.

18. The method of claim 17, wherein setting the TAC tool in the casing comprises:

biasing the uphole cage carrying the uphole slips on the mandrel toward uphole cone faces of the opposing cone faces; and dragging the downhole cage carrying the downhole slips on the mandrel against the casing.

19. The method of claim 17, wherein moving the setting mechanism comprises manipulating a J-slot and a pin arrangement between the mandrel and the downhole cage carrying the downhole slips on the mandrel.

20. The method of claim 17, wherein engaging the sleeve in the longitudinal freedom with the uphole and downhole cages comprises engaging pins in longitudinal slots arranged between the sleeve and the uphole and downhole cages.

* * * * *